US007216620B1

(12) United States Patent
Vichinsky

(10) Patent No.: US 7,216,620 B1
(45) Date of Patent: May 15, 2007

(54) ENGINE LOWER INTAKE MANIFOLD AND METHOD FOR MAKING THE SAME

(75) Inventor: Kevin Vichinsky, Portage, MI (US)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 11/352,258

(22) Filed: Feb. 13, 2006

(51) Int. Cl.
*F02M 35/10* (2006.01)

(52) U.S. Cl. ..... 123/184.61; 264/238.1
(58) Field of Classification Search ..... 123/184.61; 264/299, 328.1
See application file for complete search history.

(56) References Cited

U.S. PATENT DOCUMENTS 6,581,561 B1 * 6/2003 Brodesser et al. ..... 123/184.61
2004/0154574 A1 * 8/2004 Menin ..... 123/184.61

* cited by examiner

*Primary Examiner*—Noah P. Kamen
(74) *Attorney, Agent, or Firm*—Crowell & Moring LLP

(57) ABSTRACT

A method for making a lower intake manifold of an internal combustion engine includes the steps of (1) forming a main part from a plastic material by injection molding, (2) forming a runner insert for each engine cylinder from a plastic material by injection molding, and (3) individually attaching each runner insert to the main part to ensure the distance between two adjacent runner inserts is within a predetermined limit.

12 Claims, 2 Drawing Sheets

ENGINE LOWER INTAKE MANIFOLD AND METHOD FOR MAKING THE SAME

FIELD OF THE INVENTION

The present invention relates to a lower intake manifold of an internal combustion engine and a method for making the lower intake manifold.

BACKGROUND OF THE INVENTION

The air intake manifold of an internal combustion engine generally consists of upper and lower intake manifolds, which are attached to each other to form the air intake manifold. The lower intake manifold has "runners" (or conduits), each of which provides fluid communication between the intake manifold and a cylinder of the engine to allow airflow from the intake manifold to the cylinder.

At present, the lower intake manifold is made from aluminum and consists of two parts: a main casting and an insert. The insert is attached to the main casting with screws and sealed against the main casting with a gasket. The runners are part of the insert.

While it is efficient and cost-effective to make the lower intake manifold by injection-molding of a plastic material, a lower intake manifold, which is originally designed to be made from aluminum main casting and insert, can be difficult to make by injection-molding of a plastic material. First, because of the relatively complicated geometry of the lower intake manifold that is originally designed to be made from aluminum main casting and insert, mold cores cannot be removed intact after molding. Thus, only lost-core injection molding can be used to make the lower intake manifold in one piece. However, lost-core injection molding may be prohibitively expensive.

Second, although making the lower intake manifold from two injection-molded parts, such as a main part and an insert that includes the runners, allows removal of mold cores and thus is less expensive, injection-molded parts are often not sufficiently precise to satisfy the required tolerances. Specifically, it is often difficult to keep the distances between runners sufficiently consistent and precise to satisfy the required tolerances, due to, for example, the warping of the injection-molded insert.

SUMMARY OF THE INVENTION

The present invention solves the problems associated with the prior art by providing a separate runner insert for each cylinder of the engine.

In accordance with one aspect of the invention, a method for making an engine lower intake manifold includes (1) forming a main part from a plastic material by injection molding, (2) forming a runner insert for each engine cylinder from a plastic material by injection molding, and (3) individually attaching each runner insert to the main part to ensure the distance between two adjacent runner inserts is within the predetermined limits. Preferably, each of the main part and runner inserts is made using non-lost-core injection molding.

In accordance with another aspect of the invention, an engine lower intake manifold includes a main part and a runner insert for each engine cylinder, wherein each runner insert is individually attached to the main part to ensure the distance between two adjacent runner inserts is within predetermined limits. Both the main part and the runner inserts are formed from an injection molded plastic material.

Further, various methods can be used to attach each runner insert to the main part. For example, each runner insert can be attached to the main part using ultrasonic welding. For another example, each runner insert can be attached to the main part using laser welding. Additionally, each runner insert can be attached to the main part using a snap fit. Each runner insert can also be glued to the main part.

The present invention has various advantages. Compared with prior art aluminum lower intake manifolds, the injection-molded lower intake manifold of the present invention is less expensive to make. At the same time, the lower intake manifold of the present invention meets the tolerance requirements, in particular, the tolerance requirement for the distance between two runners. Additionally, the present invention does not require the use of expensive lost-core injection molding.

DETAILED DESCRIPTION OF THE PREFERRED EMBODIMENTS

Figure 1:
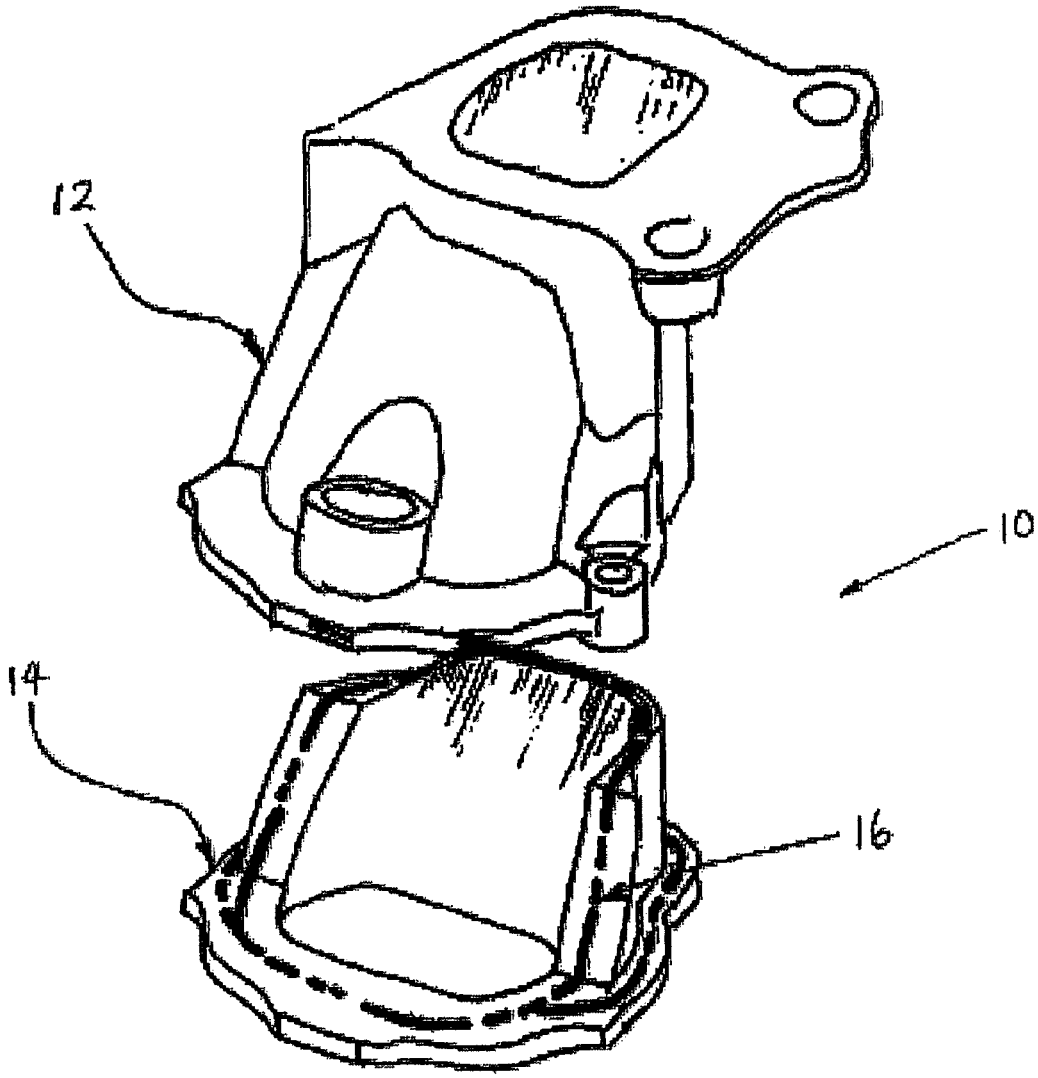
FIG. 1 is a perspective view of a portion of a lower intake manifold of the present invention before the lower intake manifold is assembled.
Figure 2:
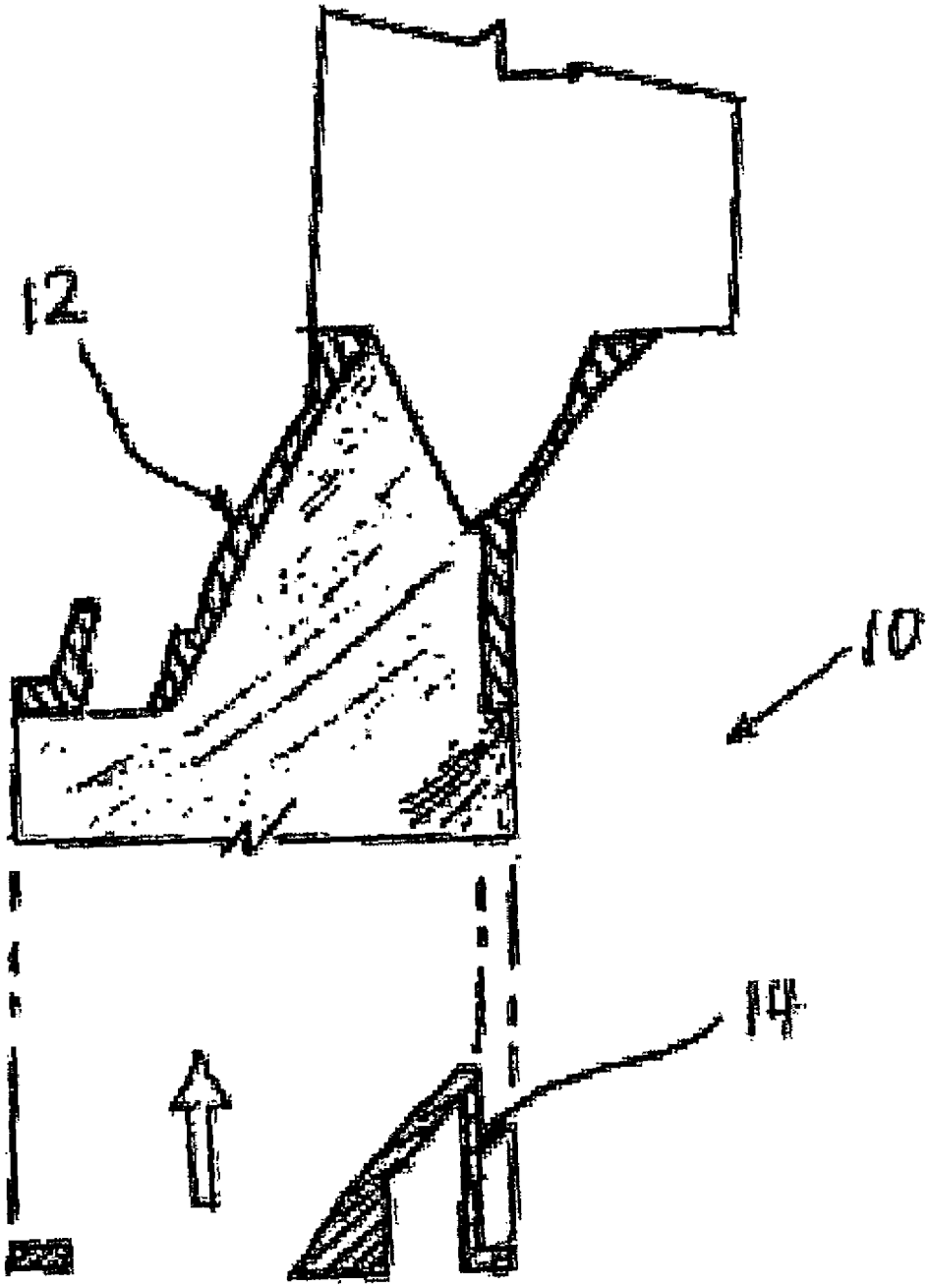
FIG. 2 is a cross-section view of the manifold portion of the present invention.

A lower intake manifold of the present invention includes a main part and a runner insert for each engine cylinder. FIG. 1 illustrates a portion of the lower intake manifold that corresponds to one runner, before the lower intake manifold is assembled. The other portions of the lower intake manifold that correspond to the other runners are substantially similar to the one shown in FIG. 1.

The manifold portion 10 shown in FIG. 1 includes a portion of the main part 12 and a runner insert 14 attached to the main part portion 12. To avoid the use of lost-core injection molding, the main part 12 and runner inserts 14 are configured so that each can be made with injection molding with recoverable cores. The configuration of the main part 12 and runner inserts 14 can be accomplished by a person with ordinary skill in the art and thus is not discussed here in detail.

The main part 12 preferably is made in one piece using injection molding of a plastic material. The main part 12 may have various configurations that can be used to attach the lower intake manifold to the upper intake manifold and to the engine block.

Preferably, each runner insert 14 also is made in one piece using injection molding of a plastic material. The runner insert 14 can be sealingly attached the main part 12 along some or all of its surfaces 16 that come in contact with the main part 12. Some of these surfaces 16 are designated in FIG. 1 by broken lines.

The runner inserts 14 are individually attached to the main part 12, and the positions of the runner inserts 14 are adjusted to ensure that the distances between runner inserts 14 meet the required tolerances.

The runner inserts 14 can be attached the main part 12 using various suitable methods, such as ultrasonic welding, laser welding, gluing and/or snap fit.

What is claimed is:

1. A method for making a lower intake manifold of an internal combustion engine having two or more cylinders, comprising the steps of:

forming a main part from a plastic material by injection molding;

forming a runner insert for each engine cylinder from a plastic material by injection molding; and individually attaching each runner insert to the main part to ensure the distance between two adjacent runner inserts is within a predetermined limit.

2. The method of claim 1, wherein the step of attaching includes attaching each runner insert to the main part using ultrasonic welding.

3. The method of claim 1, wherein the step of attaching includes attaching each runner insert to the main part using laser welding.

4. The method of claim 1, wherein the step of attaching includes gluing each runner insert to the main part.

5. The method of claim 1, wherein the step of attaching includes attaching each runner insert to the main part using a snap fit.

6. The method of claim 1, wherein each of the main part and runner inserts is made using non-lost-core injection molding.

7. A lower intake manifold of an internal combustion engine having two or more cylinders, comprising:

a main part formed from an injection molded plastic material; and a runner insert for each engine cylinder formed from an injection molded plastic material, wherein each runner insert is individually attached to the main part to ensure the distance between two adjacent runner inserts is within a predetermined limit.

8. The manifold of claim 7, wherein each runner insert is individually attached to the main part using ultrasonic welding.

9. The manifold of claim 7, wherein each runner insert is individually attached to the main part using laser welding.

10. The manifold of claim 7, wherein each runner insert is individually glued to the main part.

11. The manifold of claim 7, wherein each runner insert is individually attached to the main part using a snap fit.

12. The manifold of claim 7, wherein each of the main part and runner inserts is made using non-lost-core injection molding.

* * * * *